US007703241B2

(12) United States Patent
Eshel et al.

(10) Patent No.: US 7,703,241 B2
(45) Date of Patent: Apr. 27, 2010

(54) SECURITY GATE

(75) Inventors: Yoram Eshel, Even Yehuda (IL); David Hever, Tel Aviv (IL)

(73) Assignee: EL-GO Team Ltd., Even Yehuda (IL)

( * ) Notice: Subject to any disclaimer, the term of this patent is extended or adjusted under 35 U.S.C. 154(b) by 1364 days.

(21) Appl. No.: 11/098,441

(22) Filed: Apr. 5, 2005

(65) Prior Publication Data

US 2006/0218863 A1 Oct. 5, 2006

(51) Int. Cl.
*E05D 15/02* (2006.01)

(52) U.S. Cl. ..... 49/42; 109/6; 109/8

(58) Field of Classification Search ..... 49/35, 49/42, 44, 45, 49; 109/2, 3, 6, 8
See application file for complete search history.

(56) References Cited

U.S. PATENT DOCUMENTS 1,629,790 A * 5/1927 Hirsch et al. ..... 49/70
2,258,896 A 10/1941 Kelker
3,606,698 A * 9/1971 Tanaka ..... 49/35
3,742,647 A 7/1973 Tomita
4,026,069 A * 5/1977 Bohnett ..... 49/49
4,184,289 A * 1/1980 Lambertson ..... 49/42
4,358,909 A * 11/1982 Trikilis ..... 49/42
4,472,908 A * 9/1984 Wanzl et al. ..... 49/25
4,989,368 A 2/1991 Trikilis
5,311,166 A * 5/1994 Frye ..... 340/541
5,444,941 A 8/1995 Gallenschutz
5,634,295 A * 6/1997 Bunzl ..... 49/45
5,711,111 A * 1/1998 Nyffenegger et al. ..... 49/42
5,845,692 A * 12/1998 Kellem et al. ..... 160/118
6,185,867 B1 * 2/2001 McGuire ..... 49/109
6,725,603 B1 * 4/2004 Pansini ..... 49/42

* cited by examiner

*Primary Examiner*—Jerry Redman
(74) *Attorney, Agent, or Firm*—Mark M. Friedman

(57) ABSTRACT

A security gate for controlling passage of personnel through an accessway to or from a controlled-access region, the security gate including: (a) a first support structure deployed on a first side of the accessway; (b) a second support structure deployed on a second side of the accessway opposite the first support structure; (c) for each of the first and second support structures, a first set of vertically-spaced elongated barrier elements extending from the support structure in a first barrier formation and a second set of vertically-spaced elongated barrier elements extending from the support structure in a second barrier formation; and (d) a mechanical actuator system deployed so as to synchronously move at least the first and second barrier formations of the first and second support structures such that: (i) the first and second barrier formations assume a first state in which the first barrier formations are spaced apart to allow entrance of a person into the gate from an entrance side while the elongated barrier elements of the second barrier formations of the first and second support structures are at least partially interspaced so as to prevent passage of a person from the gate to an exit side, and (ii) the first and second barrier formations assume a second state in which the second barrier formations are spaced apart to allow exit of a person from the gate to an exit side while the elongated barrier elements of the first barrier formations of the first and second support structures are at least partially interspaced so as to prevent entry of a person from the entrance side into the gate.

9 Claims, 8 Drawing Sheets

SECURITY GATE

FIELD AND BACKGROUND OF THE INVENTION

The present invention relates to security gates and, in particular to security gates devices that allow for controlled entry of people into a compound, controlled exit from the compound, prevention of people from passing through, and even trapping a person.

Gates that allow entrance into and exit from compounds have been used from time immemorial. Passages through walled towns and citadels were often protected by gates in the walls, as well as drawbridges over moats.

Modern times have presented several new solutions, examples of which are presented below:

A turn-stile gate is described in U.S. Pat. No. 2,258,896 of Kelker. FIG. 1 of the prior art illustrates a turn-stile gate 10. Turn-stile gate 10, includes horizontal bars 13 disposed at intervals one above the other. Each horizontal bars 13, is perpendicularly connected through one of two vertical poles 11. Each of the poles 11 has full rotational movement ability on the horizontal plane. Two sectorial arched fences comprised of fixed vertical bars 12 are disposed externally and at a suitable radius. The passage of people is performed by rotational movement of the pole 11 with the horizontal bars 13 connected to it, in the space between the pole 11 and the fences 12. The turn-stile gate 10 has an acute disadvantage as a result of the wide berth necessary in the location of its disposition.

Gate equipment for permitting or preventing the passage there through is described in U.S. Pat. No. 3,742,647 of Tomita. FIG. 2 of the prior art illustrates a gate equipment 20 for permitting or preventing the passage there through. Gate 20 includes two low lateral walls 21 and two doors 22, each of which has limited rotational movement on the horizontal plane on an axis disposed at one of the walls 21. The gate 20 is not suited for prevention of forced entry, through or above it.

A revolving gate includes an elongated pivot column having an integrally formed first grooves extending longitudinally there along at equidistantly spaced intervals there around is described in U.S. Pat. No. 4,989,368 of Trikilis. FIG. 3 of the prior art illustrates a revolving gate 30. Revolving gate 30 includes horizontal rods 32 disposed at intervals one above the other on three vertical planes. Each horizontal rod 32 is connected on one end perpendicularly to vertical pole 31.

The pole 31 has full rotational movement ability on the horizontal plane. On one side of the vertical pole 31 there is a fence comprised of horizontal bars 33 that prevents the passage of people, and on the other side of the vertical pole 31 there is an additional fence 34 for the prevention of passage of people, which is shaped as an arch sector.

The passage of people is enabled when the pole 31 and the horizontal rods 32 connected to it rotate. The passage is in the area between the pole 31 and the arched fence 34. The revolving gate 30 has an acute disadvantage as a result of the wide berth necessary in the location of its disposition.

A mantrap, in which a demarcation in shape of a segment of an arc that is provided at one side of a passage, is described in U.S. Pat. No. 5,444,941 of Gallenschiitz. FIGS. 4*a*-4*e* of the prior art illustrates a mantrap 40. Mantrap 40 includes a vertical pole 41 with full rotational movement ability on the horizontal plane, through which horizontal rods 42 are disposed perpendicularly at intervals one above the other. On one side of the pole 41 there is another vertical pole 47 with limited rotational movement ability on the horizontal plane, to which the ends of horizontal rods 46 are connected at intervals one above the other. On the other side of the pole 41 there is an arched fence 44 with a sector of approximately half a circle. Passage and prevention of passage of people are enabled in the space between the pole 41 and the fence 44. The horizontal rods 46 enable the prevention of passage of people between the pole 41 and pole 47 when they are disposed as shown in frontal view in FIG. 4*a,* and top views in FIGS. 4*c* and 4*d*. When the horizontal rods 46 are rotated to approximately 90 degrees on the horizontal plane, and the horizontal rods 42 are parallel to them, as depicted in FIG. 4*e*, free passage of people is enabled, as depicted in FIG. 4*b*. If a person is within the space between the pole 41 and the fence 44 with the horizontal rods 42 stopped at the position depicted in FIG. 4*c*, the person is trapped. The mantrap 40 has an acute disadvantage as a result of the wide berth necessary in the location of its disposition.

At present, there is a need for a security gate that includes one or more of the characteristics and/or functions:

a. Preventing the passage of people, and/or baggage, and/or animals through it, around it, above it, and under it.

b. Controlled bilateral passage through it.

c. Trapping a person within it.

d. Free passage, when necessary, such as emergency evacuation from the compound.

e. Efficient usage of the area in which the security gate is installed, and particularly conservation of the required width dimension, perpendicular to the direction of movement of people through it.

None of the prior art devices comprises all of the above characteristics and functions.

There is therefore a need for a security gate, which comprises a combination of all of the above characteristics and functions.

SUMMARY OF THE INVENTION

It is an objective of the present invention to provide the means for a security gate that includes at least one of the characteristics and functions:

a. Preventing the passage of people, and/or baggage, and/or animals through it, around it, above it, and under it.

b. Controlled bilateral passage through it.

c. Trapping a person within it.

d. Free passage, when necessary, such as emergency evacuation from the compound.

e. Efficient usage of the area in which the security gate is installed, and particularly conservation of the required width dimension, perpendicular to the direction of movement of people through it.

The preferred embodiment includes all five of these characteristics and functions.

According to the teachings of the present invention there is provided a security gate for controlling passage of personnel through an accessway to or from a controlled-access region, the security gate including: (a) a first support structure deployed on a first side of the accessway; (b) a second support structure deployed on a second side of the accessway opposite the first support structure; (c) for each of the first and second support structures, a first set of vertically-spaced elongated barrier elements extending from the support structure in a first barrier formation and a second set of vertically-spaced elongated barrier elements extending from the support structure in a second barrier formation; and (d) a mechanical actuator system deployed so as to synchronously move at least the first and second barrier formations of the first and second support structures such that: (i) the first and second barrier formations assume a first state in which the first barrier formations are spaced apart to allow entrance of a person into the gate from an entrance side while the elongated barrier elements of the second barrier formations of the first and second support structures are at least partially interspaced so as to prevent passage of a person from the gate to an exit side, and (ii) the first and second barrier formations assume a second state in which the second barrier formations are spaced apart to allow exit of a person from the gate to an exit side while the elongated barrier elements of the first barrier formations of the first and second support structures are at least partially interspaced so as to prevent entry of a person from the entrance side into the gate.

According to still further features in the described the sensation and identification means are selected from a group consisting of footstep device including weight sensor, a footstep device including presence sensor, a magnetic card reader, an electronic chip reader, and a biometric identification device, a camera, computer, an infra red detector, LASER device, Roentgen device, X-ray device.

According to still further features in the described preferred embodiments the security gate, wherein said mechanical actuator is further configured so as to move at least the first and second barrier formations of the first and second support structures to an emergency access state so as to allow substantially free passage of personnel through the accessway.

According to still further features in the described preferred embodiments the security gate, wherein the first and second support structures are rotatably mounted so as to be rotatable about substantially vertical axes of rotation, and wherein the mechanical actuator system is configured to rotate the first and second support structures and hence to displace the first and second barrier formations between the first and second states.

According to still further features in the described preferred embodiments the security gate, wherein the elongated barrier elements of the first and second barrier formations are pivotally mounted to the support structures so as to be selectively displaceable between the first and second states.

According to still further features in the described preferred embodiments the security gate further including: (f) sensation and identification means; and (g) command and control means. Wherein the first and second mechanical actuator systems the sensation and identification means, and the control and command means are connected to communication system. And wherein the command and control means future enabling the control and command to be done automatically by a human being operator or by a combination of automatic control system and a human being operator 8. According to still further features in the described the sensation and identification means are selected from a group consisting of footstep device including weight sensor, a footstep device including presence sensor, a magnetic card reader, an electronic chip reader, and a biometric identification device, a camera, computer, an infra red detector, LASER device, Roentgen device, X-ray device.

According to the teachings of still another preferred embodiments of the present invention there is provided a security gate for controlling passage of baggage and/or animals through an accessway to or from a controlled-access region, the security gate including: (a) a first support structure deployed on a first side of the accessway; (b) a second support structure deployed on a second side of the accessway opposite the first support structure; (c) for each of the first and second support structures, a first set of vertically-spaced elongated barrier elements extending from the support structure in a first barrier formation and a second set of vertically-spaced elongated barrier elements extending from the support structure in a second barrier formation; and (d) a mechanical actuator system deployed so as to synchronously move at least the first and second barrier formations of the first and second support structures such that: (i) the first and second barrier formations assume a first state in which the first barrier formations are spaced apart to allow entrance of a person into the gate from an entrance side while the elongated barrier elements of the second barrier formations of the first and second support structures are at least partially interspaced so as to prevent passage of a person from the gate to an exit side, and (ii) the first and second barrier formations assume a second state in which the second barrier formations are spaced apart to allow exit of a person from the gate to an exit side while the elongated barrier elements of the first barrier formations of the first and second support structures are at least partially interspaced so as to prevent entry of a person from the entrance side into the gate.

BRIEF DESCRIPTION OF THE DRAWINGS

The invention is herein described, by way of example only, with reference to the accompanying drawings, wherein:

FIG. 2 of the prior art illustrates a gate equipment for permitting or preventing the passage there through.

DESCRIPTION OF THE PREFERRED EMBODIMENTS

Figure 1:
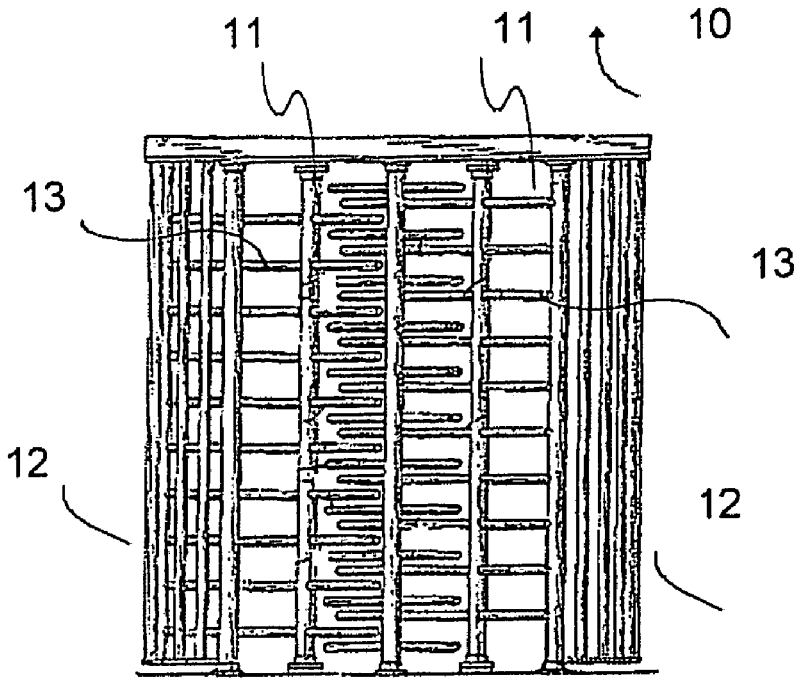
FIG. 1 PRIOR ART
FIG. 1 of the prior art illustrates a turn-stile gate.
Figure 2:
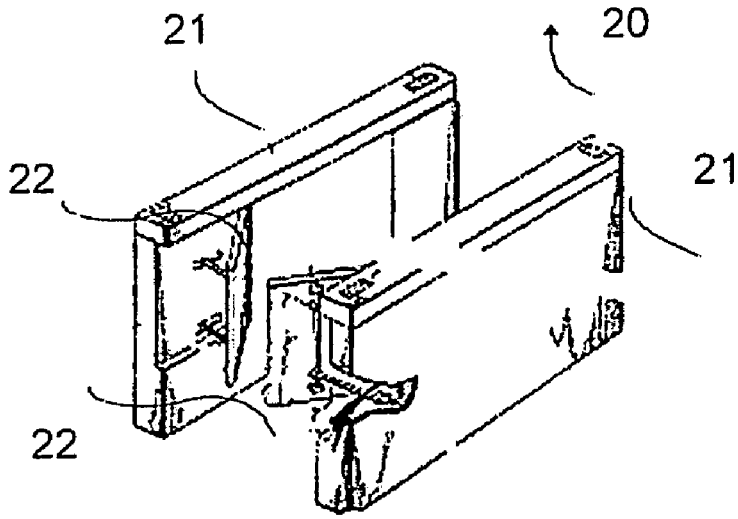
FIG. 2 PRIOR ART
Figure 3:
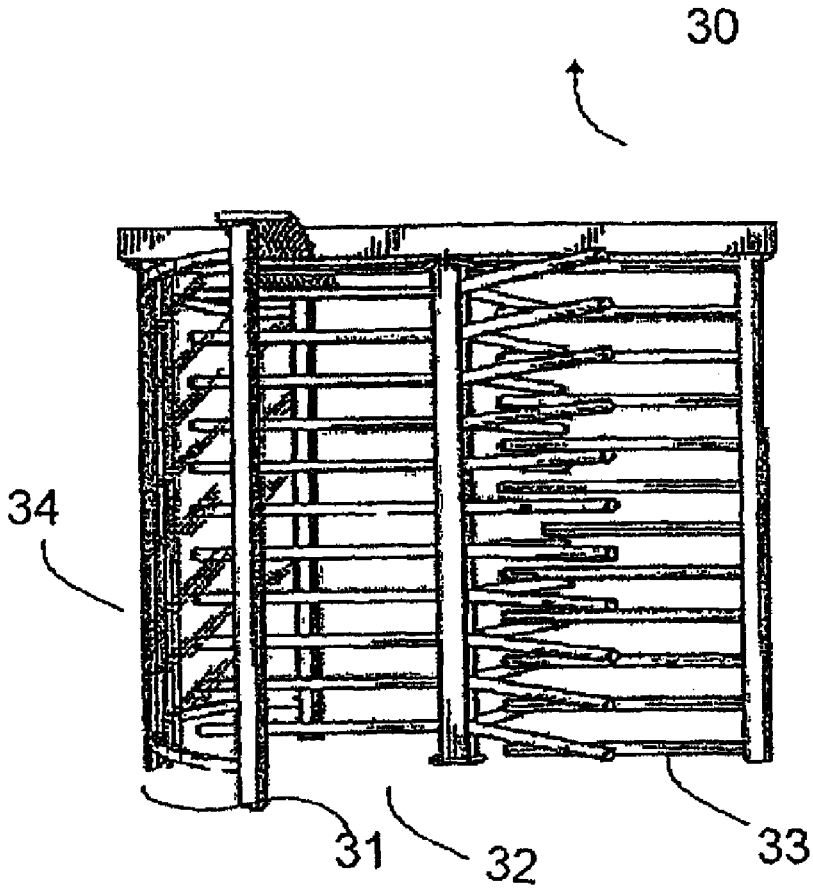
FIG. 3 PRIOR ART
FIG. 3 of the prior art illustrates a revolving gate.
Figure 4A:
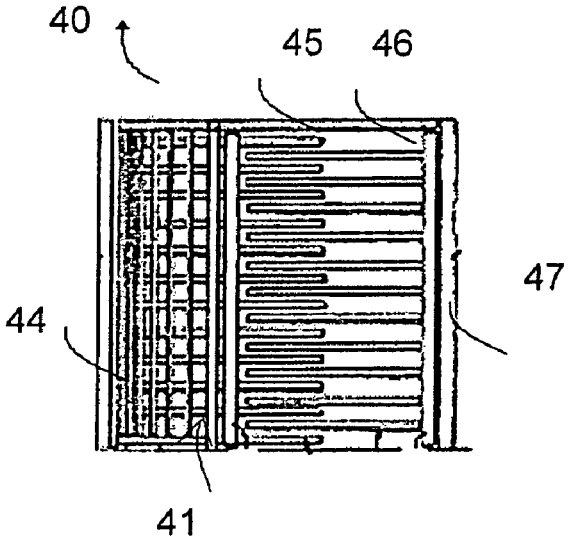
FIG. 4a PRIOR ART
FIGS. 4*a*-4*e* of the prior art illustrates a mantrap.
Figure 4B:
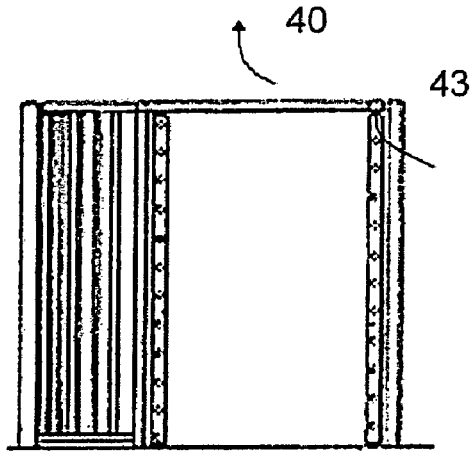
FIG. 4b PRIOR ART
Figure 4C:
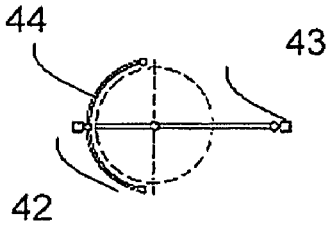
FIG. 4c PRIOR ART
Figure 4D:
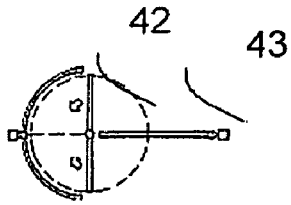
FIG. 4d PRIOR ART
Figure 4E:
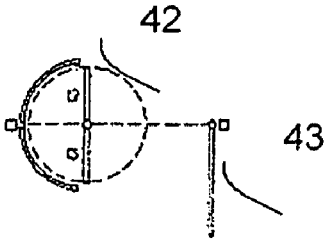
FIG. 4e PRIOR ART

The present invention is a security gate and, in particular a security gate, allows controlled entry and exit of people into and from a compound, prevention of passage of people, and trapping a person. The security gate can be disposed with means of passage prevention such as a wall and security fence, within a security area, in a narrow passage, such as a fortified hallway.

The principles and operation of a security gate according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, methods, and examples provided herein are illustrative only and not intended to be limiting.

Figure 5B:
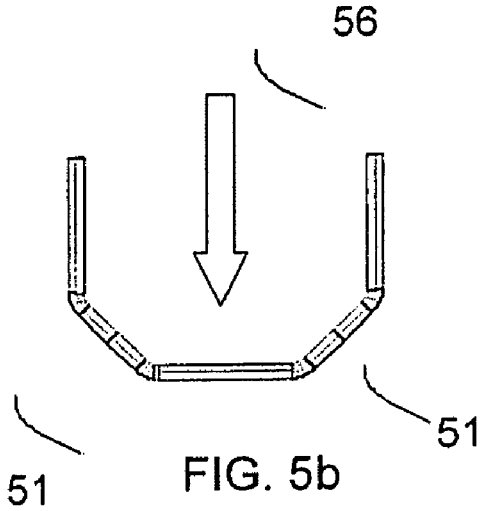
FIGS. 5*a*-5*h* are schematic illustrations of a preferred embodiment of a security gate of the present invention.
Figure 5A:
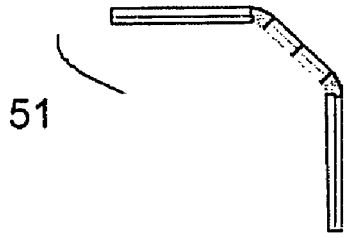
Figure 5C:
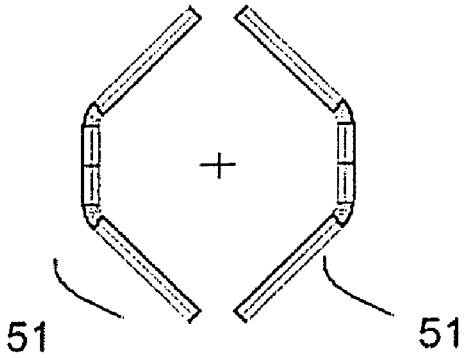
Figure 5D:
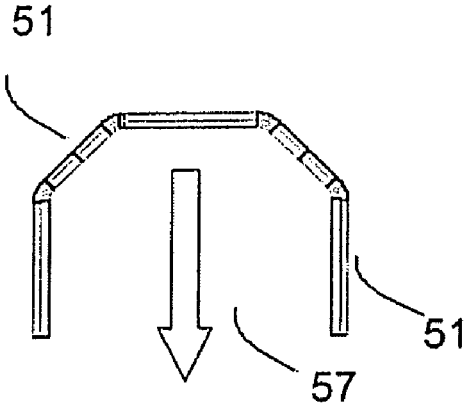
Figure 5E:
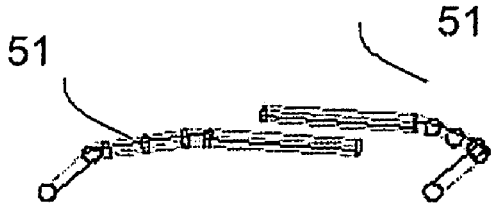
Figure 5F:
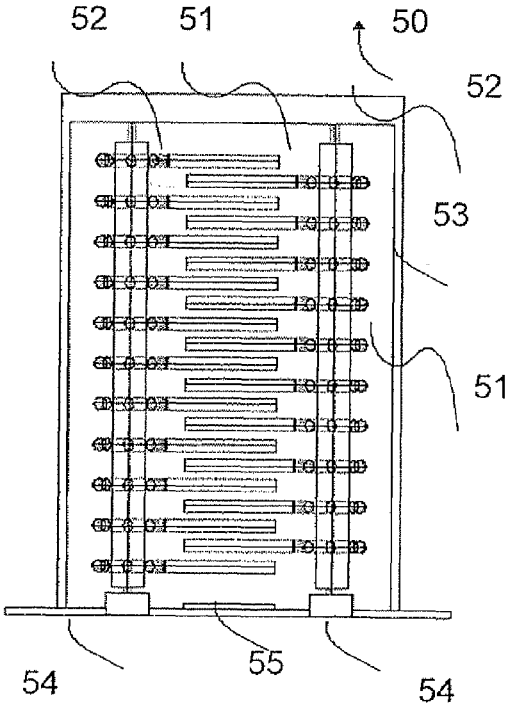
Figure 5G:
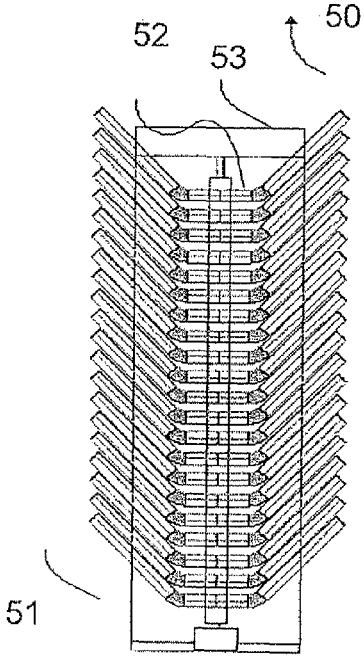
Figure 5H:
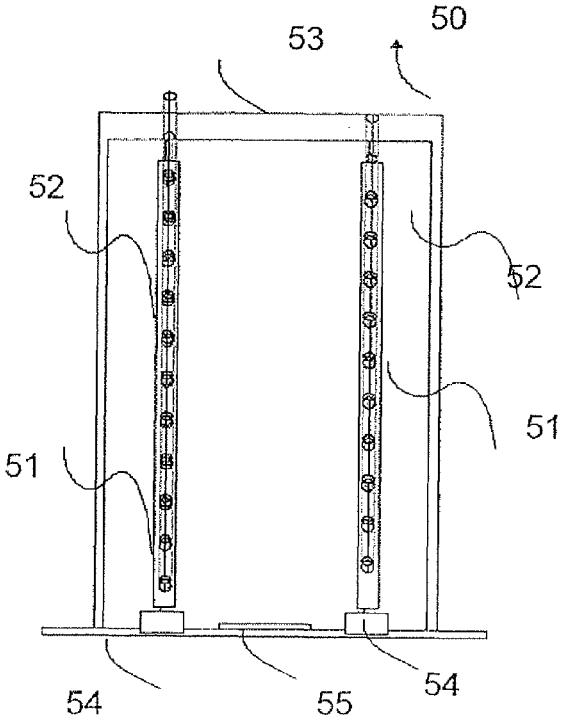

Referring now to the drawings, FIGS. 5*a*-5*g* are schematic illustrations of a preferred embodiment of a security gate 50 of the present invention. FIG. 5*a* depicts a top view of a single elongated barrier element 51 that is a component of the security gate structure 50. FIG. 5*b* depicts a top view of two elongated barrier elements 51 with vertical spacing between them, spacing that is not visible in this view, which is of sufficient width to enable the passage of people, and at the necessary distance on the horizontal plane to enable entrance to the access way as described by the arrow 56. The barrier elements 51 can be made of metal, composite material, or any other suitable material. The section of the barrier elements 51 can be round, square, polygonal, etc. The formation of the barrier elements from top view can resemble that of a bar bent into two arms at a suitable angle. At the same time, the exit is blocked. The exit from the access way and the security gate passage 50 in the direction described by the arrow 57 are possible when the elongated barrier elements 51 are in the position described from top view in FIG. 5*d*. This position is also described in isometric view in FIG. 5*e*. FIG. 5*c* describes a top view of the transitional position achieved when shifting from entry mode to exit mode. Locking the elongated barrier elements 51 in this position creates a confinement volume for detaining an enclosed person. The mode of exit from the gate 50 is described in frontal view in FIG. 5*e*. The illustration depicts, extending vertically-spaced elongated barrier elements 51 from two support structures 52 in barrier formations. Each of the two support structures 52 has rotational movement ability about substantially vertical axes of rotation.

The materials of the support structures 52 can be similar to those of the barrier elements 51. A rotational movement range of approximately 45 degrees for the support structures 52 should suffice. The movement range of the support structures 52 is of back-and-forth movement, there is no need for full rotational movement of 360 degrees or more. This movement is generated by a mechanical actuator system 54 that receives commands from a command and control system, which can receives data from sensors, such as the weight sensor 55. The gate 50 can be fixed in a frame 53. The modes and/or states described can be selected by an automatic command and control system receiving data from a group of other sensors, such as: a magnetic card reader; an electronic chip reader; a biometric identification device; a code keyboard; or any other means of identification. Command and control can be performed by a human, or by a combination of automatic and manual means.

The command and control system can be a system that is able to determine if a person is either suspect or has not met the criteria that indicates the person as authorized to enter the compound, and to prevent unauthorized entry such as the entry of two people through the gate simultaneously or of a person carrying suspect equipment through the gate. In certain occasions, such as emergency evacuation of a compound due to a fire, the gate 50 is required to be open for free passage. This is optimally possible when all of the elongated barrier elements 51 are rotated upwards and positioned in vertical planes parallel to the access way. This position is described in side view in FIG. 5*f* and in frontal view in FIG. 5*g*.

The mechanism for performance of the upward rotational movement can include mechanical systems, such as arms, springs and cogwheels, pistons, and actuating engines. The movement's power source can also be a single-use source such as pressurized nitrogen bottles or pyrotechnic charges. Returning the system to normal activity after operation in emergency evacuation mode can be performed either by the operating system or in the case of single-use components, by means of manual maintenance.

Security gate 50 is not restricted sorely to the passage of people but can also enable control passage of baggage and/or animals.

Figure 6B:
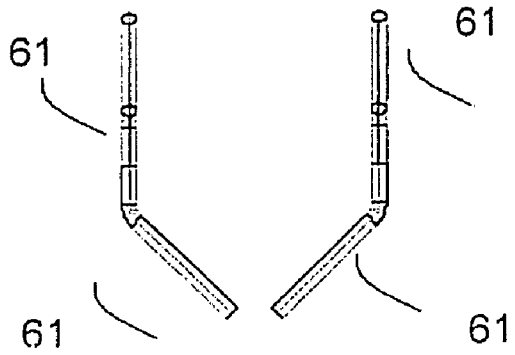
FIGS. 6*a*-6*g* are schematic illustrations of a still another preferred embodiment of a security gate of the present invention.
Figure 6A:
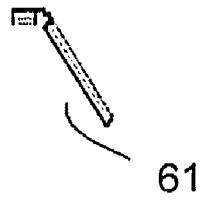
Figure 6C:
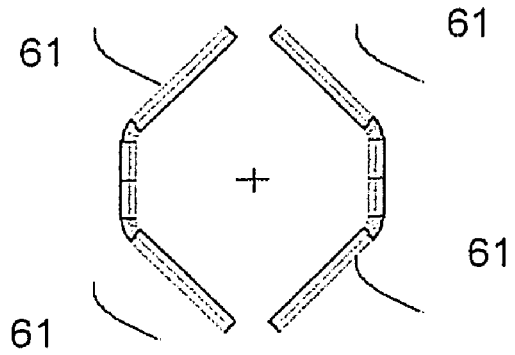
Figure 6D:
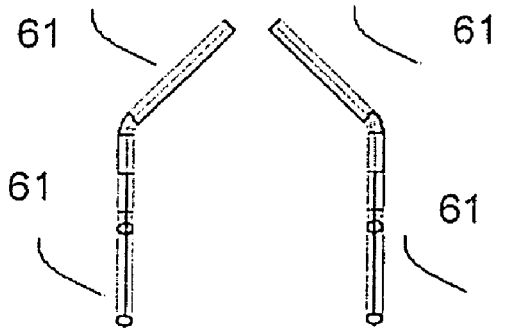
Figure 6E:
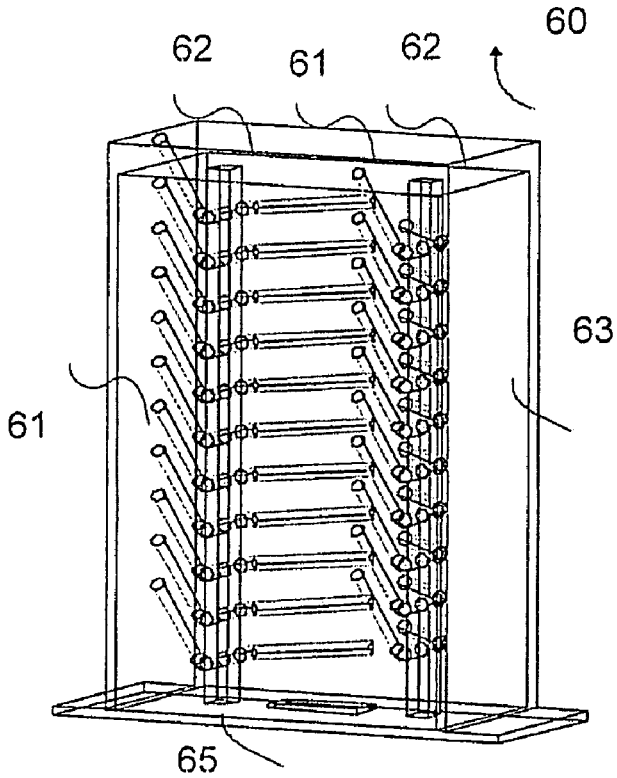
Figure 6F:
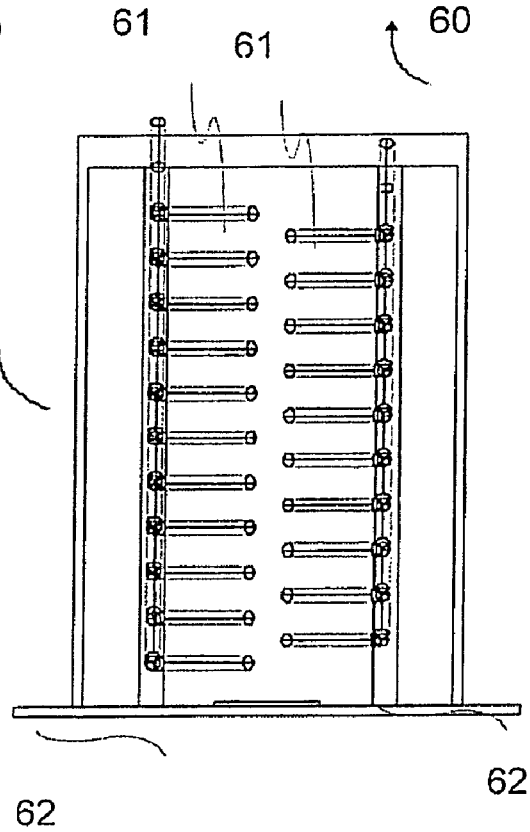
Figure 6G:
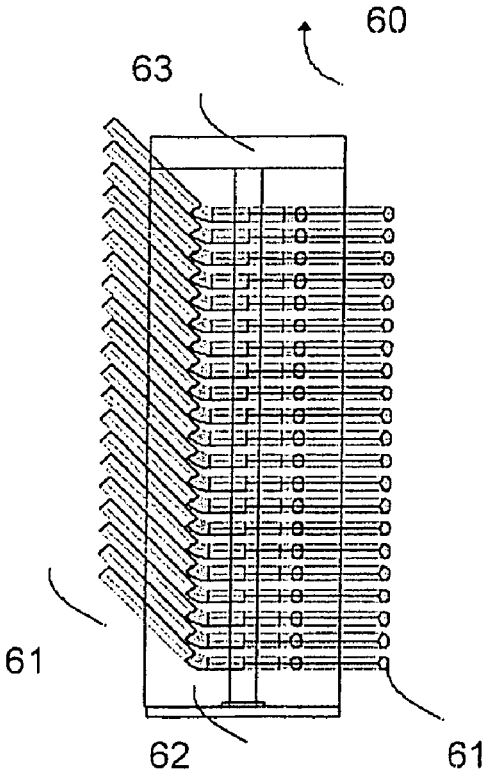

FIGS. 6*a*-6*h* are schematic illustrations of yet another preferred embodiment of a security gate 60 of the present invention. The security gate 60 as described in these figures enables the performance of the same functions as security gate 50, namely controlled passage, blocking passage, enclosing a person, and flee passage. The security gate 60 can also be disposed in narrow passages. The security gate 60 is also equipped with two support structures 62 and vertically-spaced elongated barrier elements 61 from two support structures 62 in barrier formations. Both support structures 62 are incapable of movement. Each of the elongated barrier elements 61 is shaped as approximately half of the elongated barrier elements 51 as depicted from top view in FIG. 6*a*. In the security gate 50 the rotation of the elongated barrier element 51 about a horizontal axis positions the elongated barrier element 51 in a vertical plane so that its central arm is horizontal and both of its bent arms are positioned at upward-facing angles, however in the security gate 60 additional elongated barrier elements 61 with separate movement abilities are disposed at the other side of the support structure facing the elongated barrier elements 61. Entry and/or exit modes are achieved by rotation of the additional elongated barrier elements 61 about horizontal axes and positioning them on two vertical planes, parallel to the pass way, on the side that needs to be open. At the same time, the elongated barrier elements 61 disposed on the side that needs to be closed are positioned on horizontal planes, as depicted from top view in FIGS. 6*b* and 6*d*. This position is depicted from side view in FIG. 6*g*, from front view in FIG. 6*f*, and from isometric view in FIG. 6*e*. The confinement mode described in FIG. 6*c* is achieved by positioning the elongated barrier elements 61 on both sides of the security gate 60 on horizontal planes, Free passage mode is achieved by positioning the elongated barrier elements 61 on both sides of the security gate 60 on vertical planes. The movement of the elongated barrier elements 61 can be performed by a mechanical actuator system. The security gate 60 can be fixed in a frame 63, and can also be equipped with a weight sensor 65, a command and control system, and operation methods similar to those described with regard to the security gate 50.

Security gate 50 is not restricted sorely to the passage of people but can also enable control passage of baggage and/or animals.

Figure 7A:
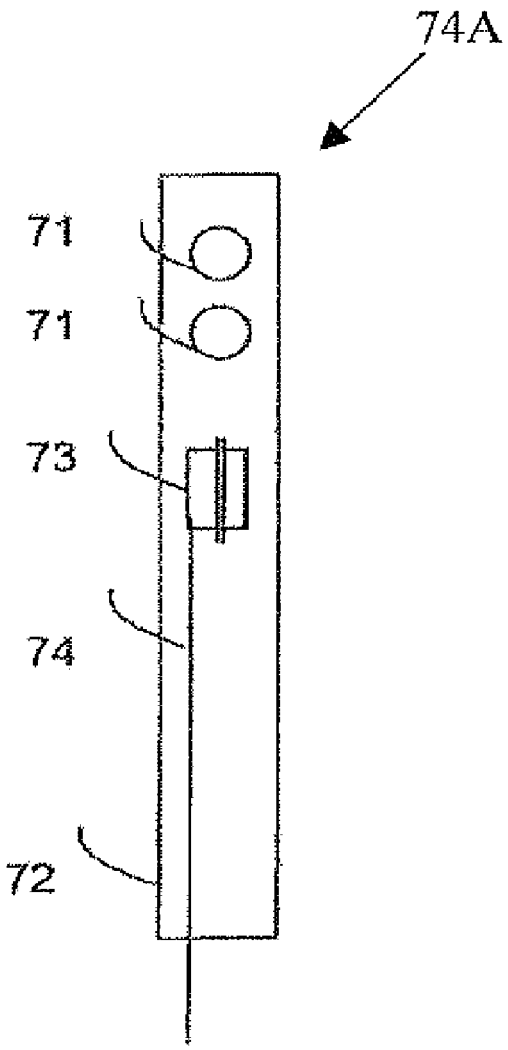
FIGS. 7*a*-7*b* are schematic illustrations of sensation and identification means, command and control means, and movement mechanism.
Figure 7B:
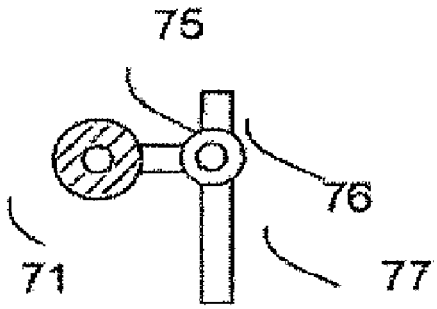

FIGS. 7*a*-7*b* are schematic illustrations of sensation and identification means, command and control means, and a movement mechanism.

FIG. 7*a* is a schematic illustration of command and control systems and communication systems 74A that can he installed in the security gates 50 and 60. The location of the components can also be on a segment of the frame 72. The components can include, for example, colored control lights 71 or an identification system such as a magnetic card reader 73 and a communication line 74.

FIG. 7*b* is a schematic illustration of a possible mechanical actuator system, one of several options for moving the elongated barrier elements 51 and/or the elongated barrier elements 61, a cross-section of which is depicted in this illustration from side view as elongated barrier elements 71. A rod 75 is rigidly connected to the elongated barrier elements 71. The other end of the rod 75 is connected with a bearing 76 to the power transmission rod 77.

What is claimed is:

1. A security gate for controlling passage of personnel, through an accessway to or from a controlled-access region, the security gate comprising:

(a) a first support structure deployed on a first side of the accessway;

(b) a second support structure deployed on a second side of the accessway opposite said first support structure;

(c) for each of said first and second support structures, a first set of vertically-spaced elongated barrier elements extending from said support structure in a first barrier formation and a second set of vertically-spaced elongated barrier elements extending from said support structure in a second barrier formation; and (d) a mechanical actuator system deployed so as to synchronously move at least said first and second barrier formations of said first and second support structures such that:

(i) said first and second barrier formations assume a first state in which said first barrier formations are spaced apart to allow entrance of a person into the gate from an entrance side while said elongated barrier elements of said second barrier formations of said first and second support structures are at least partially interspaced so as to prevent passage of a person from the gate to an exit side, and (ii) said first and second barrier formations assume a second state in which said second barrier formations are spaced apart to allow exit of a person from the gate to an exit side while said elongated barrier elements of said first barrier formations of said first and second support structures are at least partially interspaced so as to prevent entry of a person from the entrance side into the gate.

2. The security gate of claim 1, wherein said mechanical actuator is further configured so as to move at least said first and second barrier formations of said first and second support structures such that said first and second barrier formations cooperate to define a confinement volume for detaining an enclosed person.

3. The security gate of claim 1, wherein said mechanical actuator is further configured so as to move at least said first and second barrier formations of said first and second support structures to an emergency access state so as to allow substantially free passage of personnel through the accessway.

4. The security gate of claim 1, wherein said first and second support structures are rotatably mounted so as to be rotatable about substantially vertical axes of rotation, and wherein said mechanical actuator system is configured to rotate said first and second support structures to displace said first and second barrier formations between said first and second states.

5. The security gate of claim 1, wherein said elongated barrier elements of said first and second barrier formations are pivotally mounted to said support structures so as to be selectively displaceable between said first and second states.

6. The security gate of claim 1 further comprising:

(f) an identification means, and (g) a command and control means in operative connection with said mechanical actuator system and configured to be operative in a fully manual or a partially automatic mode.

7. The identification means of claim 6 selected from a group consisting of footstep device including weight sensor, a footstep device including presence sensor, a magnetic card reader, an electronic chip reader, a biometric identification device, a camera, a computer, an infra red detector, LASER device, and a X-ray device.

8. A security gate for controlling passage of baggage through an accessway to or from a controlled-access region, the security gate comprising:

(a) a first support structure deployed on a first side of the accessway;

(b) a second support structure deployed on a second side of the accessway opposite said first support structure;

(c) for each of said first and second support structures, a first set of vertically-spaced elongated barrier elements extending from said support structure in a first barrier formation and a second set of vertically-spaced elongated barrier elements extending from said support structure in a second barrier formation; and (d) a mechanical actuator system deployed so as to synchronously move at least said first and second barrier formations of said first and second support structures such that:

(i) said first and second barrier formations assume a first state in which said first barrier formations are spaced apart to allow entrance of a person into the gate from an entrance side while said elongated barrier elements of said second barrier formations of said first and second support structures are at least partially interspaced so as to prevent passage of a person from the gate to an exit side, and (ii) said first and second barrier formations assume a second state in which said second barrier formations are spaced apart to allow exit of a person from the gate to an exit side while said elongated barrier elements of said first barrier formations of said first and second support structures are at least partially interspaced so as to prevent entry of a person from the entrance side into the gate.

9. A security gate for controlling passage of animals through an accessway to or from a controlled-access region, the security gate comprising:

(a) a first support structure deployed on a first side of the accessway;

(b) a second support structure deployed on a second side of the accessway opposite said first support structure;

(c) for each of said first and second support structures, a first set of vertically-spaced elongated barrier elements extending from said support structure in a first barrier formation and a second set of vertically-spaced elongated barrier elements extending from said support structure in a second barrier formation; and (d) a mechanical actuator system deployed so as to synchronously move at least said first and second barrier formations of said first and second support structures such that:

(i) said first and second barrier formations assume a first state in which said first barrier formations are spaced apart to allow entrance of a person into the gate from an entrance side while said elongated barrier elements of said second barrier formations of said first and second support structures are at least partially interspaced so as to prevent passage of a person from the gate to an exit side, and (ii) said first and second barrier formations assume a second state in which said second barrier formations are spaced apart to allow exit of a person from the gate to an exit side while said elongated barrier elements of said first barrier formations of said first and second support structures are at least partially interspaced so as to prevent entry of a person from the entrance side into the gate.

* * * * *